United States Patent [19]

Windgassen

[11] Patent Number: 4,930,257

[45] Date of Patent: Jun. 5, 1990

[54] THERMAL BREAK DOOR FRAME ASSEMBLY

[75] Inventor: William P. Windgassen, Huntley, Ill.

[73] Assignee: National Material Limited Partnership, Ill.

[21] Appl. No.: 312,721

[22] Filed: Feb. 21, 1989

[51] Int. Cl.[5] ..... E06B 1/04

[52] U.S. Cl. ..... 49/504; 49/DIG. 1; 49/400; 49/485; 49/489; 52/212

[58] Field of Search ..... 49/DIG. 1, 485, 489, 49/497, 400, 504; 52/395, 212, 211, 210, 213

[56] References Cited

U.S. PATENT DOCUMENTS

| | | | |
|---|---|---|---|
| 4,328,273 | 5/1982 | Yackiw | 49/496 X |
| 4,467,576 | 8/1984 | Burgers | 52/212 |
| 4,514,943 | 5/1985 | Jentoft et al. | 49/DIG. 1 X |
| 4,594,831 | 6/1986 | Winyard | 49/DIG. 1 X |

*Primary Examiner*—Philip C. Kannan
*Attorney, Agent, or Firm*—Wood, Phillips, Mason, Recktenwald & Vansanten

[57] ABSTRACT

A thermal break door frame assembly includes a pair of frame members defining a groove. The groove includes a mouth opening in the area of the edge of a closed door. A unitary weatherstrip is adapted to engage the edge of the door and includes an integral thermal break tail projecting through the mouth into the groove between the frame members.

20 Claims, 1 Drawing Sheet

FIG. 1
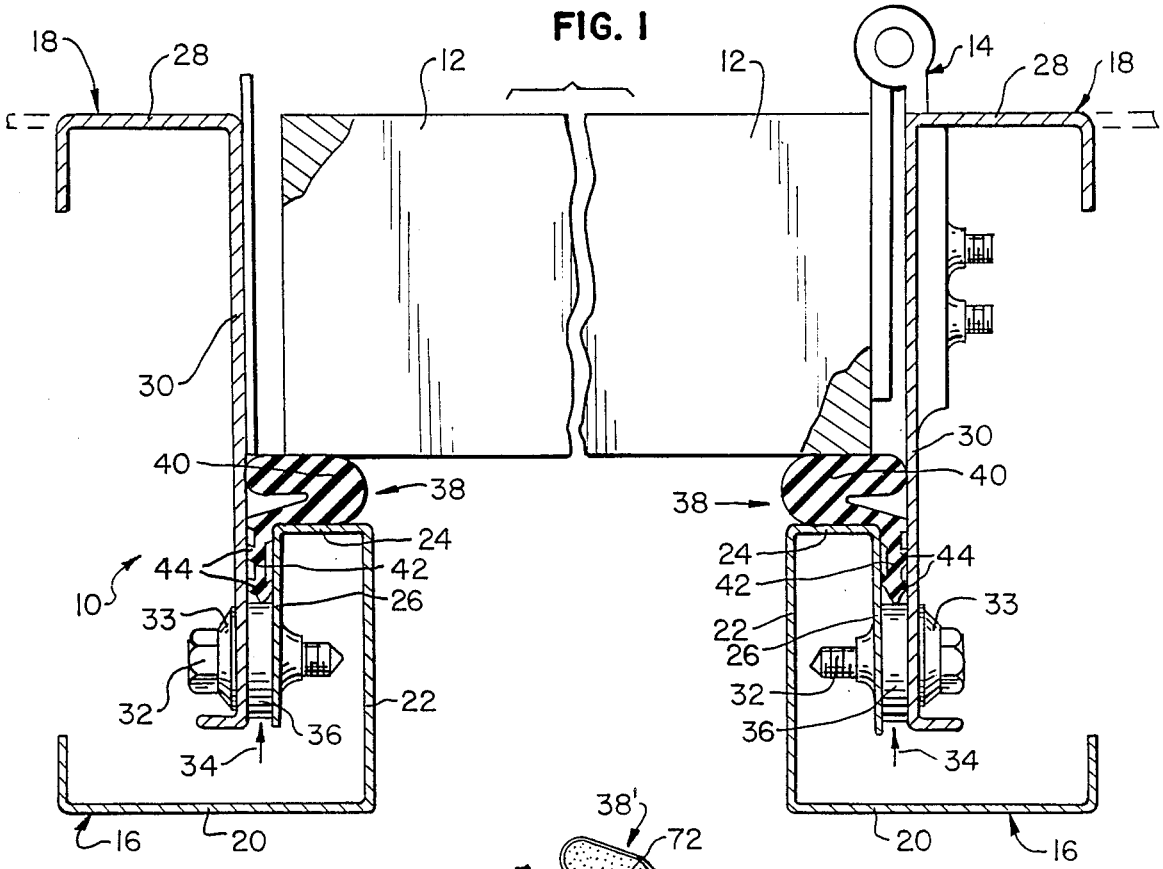
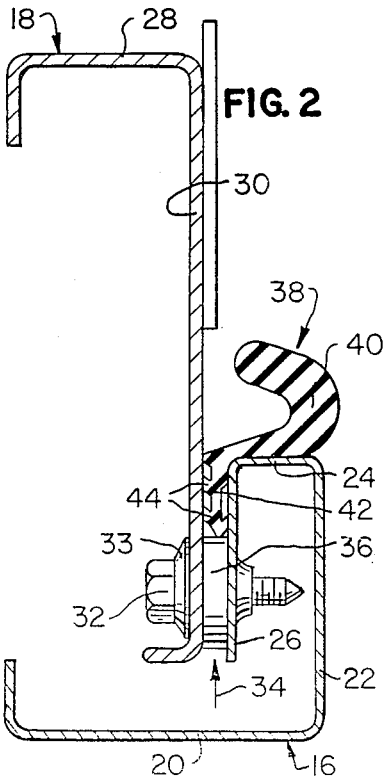
FIG. 2
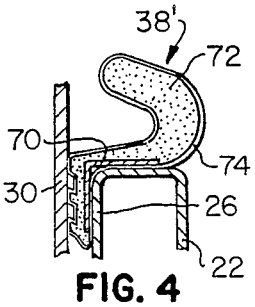
FIG. 4
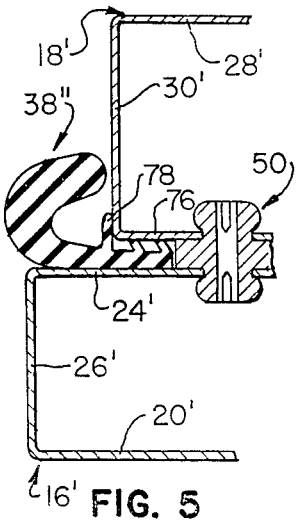
FIG. 5
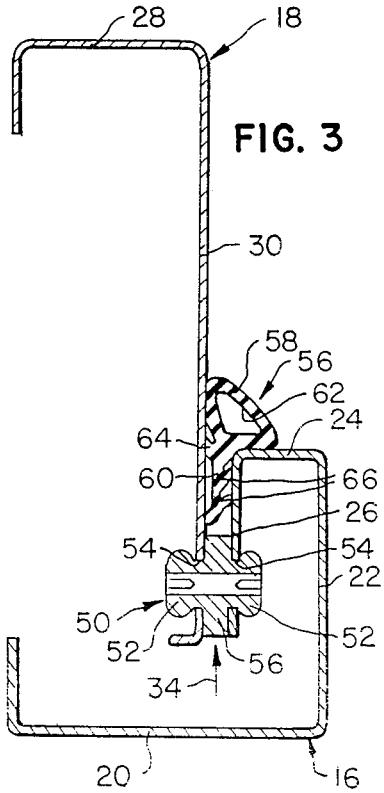
FIG. 3

THERMAL BREAK DOOR FRAME ASSEMBLY

FIELD OF THE INVENTION

This invention generally relates to frame structures for framing an exterior wall opening and, particularly, to a frame construction having a unitary thermal break and weatherstrip.

BACKGROUND OF THE INVENTION

Framing constructions for wall openings, such as to accommodate doors, usually have some form of weatherstripping or other insulating means particularly when the door opens to the outside environment. Typically, residential door frames have a wood jamb which has its inherent insulating characteristics. However, metal door jambs, such as of steel, often are used for more heavy duty applications. The use of steel framing components sacrifices the insulating characteristics of wood. Therefore, steel jambs or framing assemblies have been made of at least two pieces with an insulating barrier to solve the insulation problem inherent in the use of metal materials.

The insulating problem actually is two-fold. First, a weatherstrip is used for engagement by the door itself. Usually, the weatherstrip is compressible when the door closes to seal the door opening against air movement. Second, a thermal break must be used between the two pieces of the metal jamb to prevent conduction of heat from the interior of a building through the jamb to the exterior.

An example of a thermal break for a steel door frame is shown in U.S. Pat. No. 4,594,831 to Winyard, dated June 17, 1986. That patent shows a thermal break of rigid, low.-thermoconductive material, such as vinyl or the like, comprising a multi-faceted flanged component for receiving the flanges of two metal frame members, one of the members forming the soffit and stop of the door jamb and the other member forming the rabbet of the door jamb. Such a multi-faceted construction is widely used but rather complicated to assemble, replace or maintain. In fact, Winyard's preferred construction is made into pieces just to allow for replacement of the weatherproofing strip portion of the thermal break as it wears out or is damaged in use.

This invention is directed to solving such problems with a very simple door frame assembly incorporating a unitary weatherstrip with an integral thermal break.

SUMMARY OF THE INVENTION

An object, therefore, of the invention is to provide a new and improved thermal break door assembly having a unitary thermal break/weatherstrip component.

In the exemplary embodiments of the invention, the assembly includes a first metal frame member having a soffit, a stop along one side of the soffit and a return flange extending from the stop behind and lengthwise of the soffit. A second metal frame member has a rabbet combining with the return flange of the first member to define a groove therebetween and extending lengthwise of the frame assembly. A unitary weatherstrip is adapted to engage along the stop of the first frame member and the rabbet of the second frame member and includes an integral thermal break tail projecting into the groove between the rabbet and the return flange of the first frame member.

With such a structure, the entire unitary weatherstrip/thermal break is easily removed and replaced by pulling the strip out of the groove defined between the frame members. Preferably, the tail which projects within the groove includes at least one locking rib for engaging either the soffit or the return flange which combine to form the groove. In the preferred embodiments, the locking rib is angled back toward the weatherstrip at the mouth of the groove to prevent unintentional outward shifting of the strip.

In one embodiment of the invention, the weatherstrip is fabricated of a resilient material, and in another embodiment as a hollow structure, to provide for compressibility by a door. The weatherstrip may be formed as an arcuate flange to further provide for compressibility. The weatherstrip may be fabricated with a rigid interior frame piece substantially surrounded by a soft spongy material which, in turn, is surrounded by a flexible covering.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements, in the figures and in which:

FIG. 1 is a horizontal section through a thermal break door frame assembly incorporating the concepts of the invention;

FIG. 2 is a horizontal section of the left-hand portion of the frame assembly shown in FIG. 1, illustrating the weatherstrip in expanded condition;

FIG. 3 is a horizontal section through one side of a door frame assembly to illustrate an alternate embodiment of the unitary weatherstrip/thermal break of the invention;

FIG. 4 is a fragmented section illustrating a further embodiment of the unitary weatherstrip/thermal break of the invention; and FIG. 5 is a horizontal section through another form of thermal break door assembly incorporating another unitary weatherstrip/thermal break of the invention.

DETAILED DESCRIPTION OF THE PREFERRED EMBODIMENT

Referring to the drawings in greater detail, and first to FIG. 1, a framing structure, generally designated 10, is shown for mounting a door 12 by means of a hinge, generally designated 14. FIG. 1 is a horizontal section through the frame structure to show the left and right-hand portions thereof. However, it should be understood that the weatherstrip/thermal break of the invention should continue around the top of the door and the framing structure (not shown). In addition, except for hinge 14, the framing structure is identical around the entire door opening and, therefore, like numerals will appear on both sides of FIG. 1.

More particularly, framing structure 10 is formed by an inside frame member, generally designated 16, and an outside frame member, generally designated 18. The frame members are fabricated of metal, such as formed steel or extruded aluminum.

Inside frame member 16 includes a face 20, a soffit 22, a stop 24 and a return flange 26 extending from stop 24 back behind and lengthwise of soffit 22.

Outside frame member 18 includes a face 28 and a rabbet 30. Hinge 14 may be formed integral with frame member 18, as shown, or comprise a separate component for attachment to door 12. Fastening means, such as bolts 32, secure the two frame members 16 and 18 in assembly. An insulating washer 33 is used beneath the head of each bolt 32 to thermally isolate the bolt from rabbet 30 of frame member 18.

It can be seen that a space or groove, indicated by arrow 34, is defined between frame members 16 and 18 by return flange 26 of frame member 16 and rabbet 30 of frame member 18. A non-thermal conductive spacer washer 36 surrounds each bolt 32 within groove 34. In fact, the bolts themselves may be fabricated of non-thermal conductive material, such as nylon.

The invention contemplates a unitary weatherstrip/-thermal break, generally designated 38, and located at the mouth of groove 34 at the general juncture area between stop 24 of frame member 16 and rabbet 30 of frame member 18. The unitary member includes a weatherstrip portion 40 and a thermal break tail 42 formed integral with weatherstrip 40 by fabrication low-thermal conductive material, such as vinyl or the like, of which is rigid enough to facilitate assembly and locking, but flexible enough for the weatherstrip portion to bend or compress as described below.

Weatherstrip portion 40 is formed as an arcuate flange as best seen in FIG. 2. In that depiction, it can be seen that the arcuate flange is expanded when not engaged by a door. Referring back to FIG. 1, it can be seen that the arcuate flange becomes compressed or bent when door 12 is closed to provide a seal between the door and stop 24 of frame member 16.

The unitary weatherstrip/thermal break 38 is very simply assembled by inserting tail portion 42 into the mouth groove 34 between return flange 26 of frame member 16 and rabbet 30 of frame member 18. A press-fit is established between the tail and the sides of the groove. When so inserted, tail 42 forms a continuous thermal break between the frame members and runs the entire length of the frame structure about the opening for door 12.

In order to prevent unintentional dislodgement of unitary weatherstrip/thermal break 38, at least one locking rib 44 is molded integral with and running the length of tail 42. Two ribs are incorporated in the preferred embodiments shown. It can be seen that locking ribs 44 are angled back toward the weatherstrip portion 40, i.e. toward the mouth of groove 34 opposite the direction of insertion. This further enhances the prevention of unintentional removal of the component. Should the unitary weatherstrip/thermal break 38 become worn or damaged in use, the component simply is removed by pulling tail 42 out of groove 34 and replaced by a new strip, again simply by inserting the tail of the new strip into the groove and the seal/thermal break functions again are restored.

FIG. 3 shows an alternative embodiment of the invention wherein bolts 32 and spacer washers 36 of the embodiment of FIG. 1 are replaced by unitary fastener/spacer components, generally designated 50. Each component 50 includes a pair of head portions 52 for snapping through holes 54 in return flange 26 of frame member 16 and in rabbet 30 of frame member 18 to fasten and secure the frame members together but in spaced relationship. To that end, each fastener/spacer component 50 includes an integral spacer portion 56 between head portions 52 to fill groove 34. The fastener/spacer components are fabricated of such material as vinyl, nylon or the like to provide sufficient flexibility to snap head portions 52 through holes 54, but to provide sufficient rigidity to hold the frame members in secure assembly.

In addition, the embodiment of FIG. 3 shows an alternate form of unitary weatherstrip/thermal break, generally designated 56, including a weatherstrip portion 58 and an integral tail portion 60. It can be seen that weatherstrip portion 58 is generally triangular for sealing against stop 24 of frame member 16 and rabbet 30 of frame member 18, as well as against the corner edge of an appropriate door. Weatherstrip portion 58 also is hollow, as at 62, to provide for compressibility. Tail 60 again is adapted for press-fit insertion into groove 34 and includes a rib 64 on one side of the tail for engaging rabbet 30, and a pair of locking ribs 66 on the opposite side of the tail for engaging return flange 26. Again, as with the embodiment of FIGS. 1 and 2, locking ribs 66 are angled back toward the mouth of groove 34, i.e. opposite the direction of insertion of the tail.

FIG. 4 shows a further embodiment of the invention wherein the unitary weatherstrip/thermal break, generally designated 38', includes a generally L-shaped, rigid interior frame piece 70 projecting into both the weatherstrip portion and the tail portion thereof. A soft spongy material 72, such as of polyurethane foam, substantially surrounds the frame piece, primarily in the weatherstrip portion. A sheet-like covering 74, such as of flexible vinyl material, surrounds the unitary weatherstrip/thermal break. Otherwise, the structure is shaped and functions similarly to the structure 38 in FIGS. 1 and 2.

FIG. 5 shows a framing structure which includes an inside frame member 16' with a face 20', a soffit 22' and a stop 24'; and an outside frame member 18' with a face 28', a rabbet 30' and an inturned flange 76. Unitary fastener/space components 50 (see FIG. 3) interconnect the inside and outside frame members. It can be seen that a groove 34' is defined between stop 24' of inside frame member 16' and inturned flange 76 of outside frame member 18'. A unitary weatherstrip/thermal break, generally designated 38'', is inserted into groove 34, and functions as described above in relation to unitary weatherstrip/thermal break 34 in FIGS. 1 and 2, except that a stop 78 is formed on the inside thereof to prevent overinsertion of the structure into the groove.

From the foregoing, it can be seen that a very simple weatherstrip/thermal break device has been provided and which utilizes a unitary component for both sealing a door against air movement and providing a thermal break between a pair of frame members. The unitary component is very easy to assemble and to replace. In addition, the thermal break tail runs the entire length of the frame assembly about the door opening and functions totally independently of the sealing function of the weatherstrip portion, notwithstanding that the two functions are afforded by a single member.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

I claim:

1. A thermal break door frame assembly, comprising:

a first metal frame member having a soffit, a stop along one side of the soffit and a return flange extending from the stop behind and lengthwise of the soffit;

a second metal frame member having a rabbet combining with said return flange to define a groove therebetween and extending lengthwise of the frame assembly; and a unitary weatherstrip adapted to engage along the stop of the first frame member and the rabbet of the second frame member and including an integral thermal break tail projecting into the groove between the rabbet and the return flange of the first frame member.

2. The thermal break door frame assembly of claim 1 wherein said tail includes at least one locking rib for engaging one of the soffit and the return flange.

3. The thermal break door frame assembly of claim 2 wherein said locking rib is angled back toward the weatherstrip.

4. The thermal break door frame assembly of claim 1 wherein the weatherstrip is hollow to provide for compressibility thereof.

5. The thermal break door frame assembly of claim 1, including non-thermally conductive spacer means in the groove between the frame members.

6. The thermal break door frame assembly of claim 5 wherein said spacer means form part of fastening means for securely assembling the frame members together.

7. A thermal break door frame assembly, comprising:

a first metal frame member having a soffit, a stop along one side of the soffit and a return flange extending from the stop behind and lengthwise of the soffit;

a second metal frame member having a rabbet combining with said return flange to define a groove therebetween and extending lengthwise of the frame assembly;

non-thermally conductive spacer means in the groove between the frame members; and a unitary weatherstrip adapted to engage along the stop of the first frame member and the rabbet of the second frame member and including an integral thermal break tail press fit into the groove between the rabbet and the return flange of the first frame member.

8. The thermal break door frame assembly of claim 7 wherein the weatherstrip is hollow to provide for compressibility thereof.

9. The thermal break door frame assembly of claim 7 wherein said spacer means form part of fastening means for securely assembling the frame members together.

10. A thermal break door frame assembly, comprising:

a first metal frame member having a soffit, a stop along one side of the soffit and a return flange extending from the stop behind and lengthwise of the soffit;

a second metal frame member having a rabbet combining with said return flange to define a groove therebetween and extending lengthwise of the frame assembly;

non-thermally conductive spacer means in the groove between the frame members; and a unitary weatherstrip adapted to engage along the stop of the first frame member and the rabbet of the second frame member and including an integral thermal break tail press fit into the groove between the rabbet and the return flange of the first frame member, said tail including at least one locking rib for engaging one of the soffit and the return flange.

11. The thermal break door frame assembly of claim 10 wherein said locking rib is angled back toward the weatherstrip.

12. The thermal break door frame assembly of claim 10 wherein the weatherstrip is hollow to provide for compressibility thereof.

13. The thermal break door frame assembly of claim 10 wherein said spacer means form part of fastening means for securely assembling the frame members together.

14. A thermal break door assembly, comprising:

first and second frame members defining a groove having a mouth opening in an area of the edge of a closed door; and a unitary weatherstrip adapted to engage said edge of the door and including an integral thermal break tail projecting through said mouth into the groove between the frame members.

15. The thermal break door assembly of claim 14, including non-thermally conductive spacer means in the groove between the frame members.

16. The thermal break door assembly of claim 14 wherein said tail is configured to press fit into the groove.

17. The thermal break door assembly of claim 14 wherein said groove is formed between a stop portion of one of the frame members and an inturned flange on the other of the frame members.

18. The thermal break door assembly of claim 14 wherein said tail includes at least one locking rib for engaging at least one side of the groove.

19. The thermal break door assembly of claim 18 wherein said locking rib is angled back toward the mouth of the groove.

20. The thermal break door assembly of claim 18 wherein said spacer means form part of fastening means for securely assembling the frame members together.

* * * * *